US008869383B2

(12) United States Patent
Xu et al.

(10) Patent No.: US 8,869,383 B2
(45) Date of Patent: Oct. 28, 2014

(54) METHOD OF MAKING MAGNETICS ASSEMBLY

(75) Inventors: Yong-Chun Xu, Kunshan (CN); Jie Zhang, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/523,076

(22) Filed: Jun. 14, 2012

(65) Prior Publication Data

US 2012/0322309 A1 Dec. 20, 2012

(30) Foreign Application Priority Data

Jun. 14, 2011 (CN) ..... 2011 1 0159038

(51) Int. Cl.
*H01F 7/06* (2006.01)
*H01F 17/06* (2006.01)
*H01F 27/28* (2006.01)

(52) U.S. Cl.
CPC ..... *H01F 17/062* (2013.01); *H01F 27/2823* (2013.01); *H01F 27/2828* (2013.01)
USPC ..... 29/605; 29/602.1; 29/604; 29/606; 29/607; 336/212; 336/214; 336/215; 336/234; 439/620.01; 439/620.06; 439/676

(58) Field of Classification Search
CPC ..... H01F 27/2828; H01F 27/2823; H01F 27/2895; H01F 27/306; H01F 27/24; H01R 13/66; H01R 13/6658; H01R 13/6633; H01R 13/6685; H05K 3/0002; H05K 13/0023
USPC ..... 29/602.1, 604, 606, 607; 336/110, 175, 336/178, 184, 215, 234; 439/620.01, 439/620.06, 676
See application file for complete search history.

(56) References Cited

U.S. PATENT DOCUMENTS

| | | | | |
|---|---|---|---|---|
| 4,717,889 | A | 1/1988 | Engelmann | |
| 6,102,741 | A * | 8/2000 | Boutros et al. | 439/620.06 |
| 7,785,135 | B2 | 8/2010 | Wu | |
| 8,487,733 | B2 * | 7/2013 | Chu et al. | 336/212 |
| 2007/0238359 | A1 * | 10/2007 | Gutierrez et al. | 439/620.01 |
| 2007/0259573 | A1 * | 11/2007 | Machado et al. | 439/676 |
| 2011/0167869 | A1 | 7/2011 | Geers | |

* cited by examiner

*Primary Examiner* — Paul D Kim
(74) *Attorney, Agent, or Firm* — Ming Chieh Chang; Wei Te Chung

(57) ABSTRACT

A magnetics assembly (100) including a transformer (1) made of litz wire. The transformer includes a toroid core (2) and a bundle of wires (3) winding around the toroid core. The bundle of wires includes first to eighth wires, and has a central portion with all eight wires twisted together and winding around the toroid core. First and second ends of the bundle of wires oppositely extend out from the toroidal core. The ends of the first to eighth wires are connected to form a primary and a secondary coils of the transformer, wherein the second ends of the first wire and the second wire, and the first ends of the third wire and the fourth wire are sorted out to form central taps (35, 36) of the primary and secondary coils, respectively.

3 Claims, 8 Drawing Sheets

METHOD OF MAKING MAGNETICS ASSEMBLY

BACKGROUND OF THE INVENTION

1. Field of the Invention

The present invention relates to a magnetics assembly and an electrical connector having the magnetics assembly, and particularly to a magnetics assembly having a transformer made of litz wire winding and method of making the magnetics assembly.

2. Description of Related Art

US 2011/0167869, published on Jul. 14, 2011, discloses a modular jack comprising an insulating housing and a plurality of terminals operatively connected to a magnetics assembly and configured to engage contacts of a mating plug. The magnetics assembly comprises a printed circuit board (PCB), a number of conductive pins connected to the PCB, and a transformer. The transformer has a toroidal core having an opening therein, four twisted wires winding around the toroidal core through the opening and having ends respectively connected to the conductive pins. The ends of the four wires are connected to form a primary and a secondary coils of the transformer, each of the primary and secondary coils having a central tap and carrying circuit in single wire.

U.S. Pat. No. 7,785,135, issued to Wu on Aug. 31, 2010, discloses an electrical connector has a housing defining an opening therein, a magnetic module mounted to the housing. The magnetic module includes a printed circuit board, a first set of terminals mounted to a front face of the printed circuit board and received in the opening, a second set of terminals mounted to a rear side of the printed circuit board, a toroidal coil pair mounted to the printed circuit board and having a first toroidal body, and a second toroidal body electrically connected with each other by a circuit provided on the printed circuit board.

Litz wire consists of multiple strands insulated electrically from each other. Ordinarily the strands are twisted or woven. Litz wire made out of eight (8) thinner isolated copper wires are typical.

SUMMARY OF THE INVENTION

The present invention provides a magnetics assembly comprising a transformer, the transformer further comprising a magnetic core shaped as a toroidal shaft extending along a circle locus around a central axial, the toroidal shaft defining a central opening, a top and a bottom faces perpendicular to the central axial, and a bundle of wires having a central portion, a first end and an opposite second end, the bundle of wires comprising a first to eighth wires, and the central portion being twisted together and winding around the magnetic core in one direction through the central opening and around the circle locus, the first end of the bundle of wires extending out from central opening through the top face, the second end of the bundle of wires extending out from the central opening of the magnetic core through the bottom face, each wire having a corresponding first end and a corresponding opposite second end. The second ends of the first wire and the second wire, and the first ends of the third wire and the fourth wire are sorted out to form a central tap, the first ends of the first wire and the second wire are sorted out to form an input of a primary coil of the transformer, and the second ends of the third wire and the fourth wire are sorted out to form an output of the primary coil of the transformer. The second ends of the fifth wire and the sixth wire, and the first ends of the seventh wire and the eighth wire are sorted out to form a central tap, the first ends of the fifth wire and the sixth wire are sorted out to form an input of a secondary coil of the transformer, and the second ends of the seventh wire and the eighth wire are sorted out to form an output of the secondary coil of the transformer.

Other objects, advantages and novel features of the invention will become more apparent from the following detailed description of a preferred embodiment when taken in conjunction with the accompanying drawings.

DETAILED DESCRIPTION OF THE INVENTION

Figure 1:
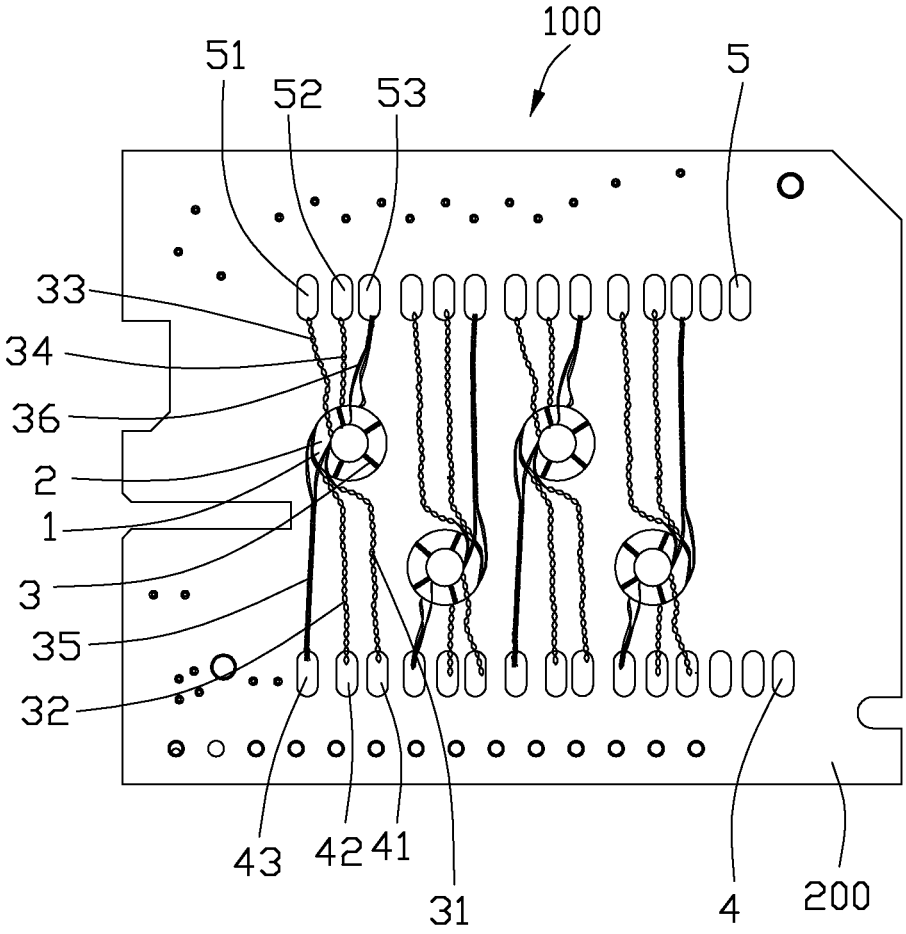
FIG. 1 is a top view of a magnetics assembly according to an embodiment of present invention.
Figure 2:
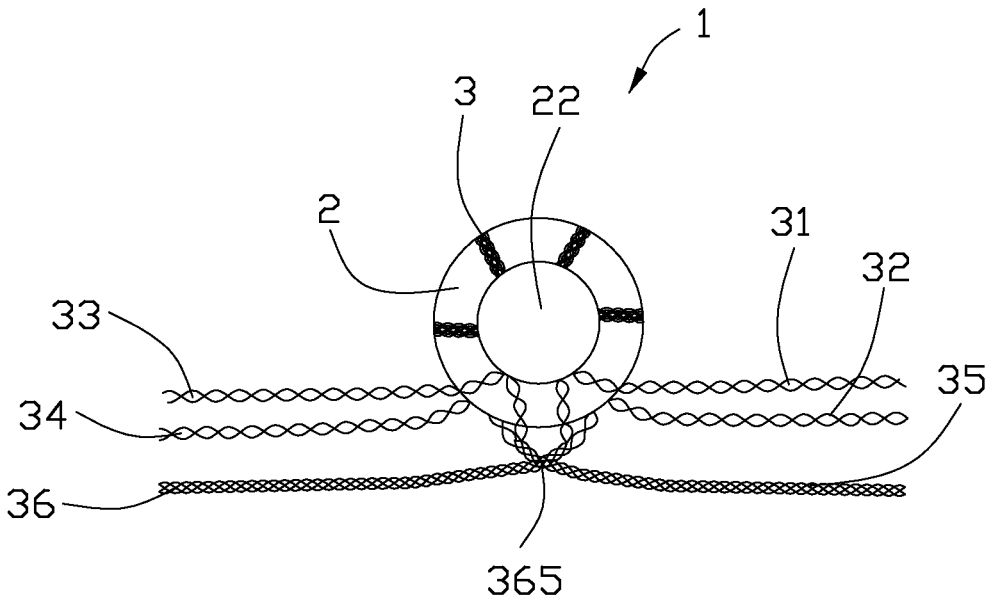
FIG. 2 is a top view of a transformer to be mounted on and a PCB shown in FIG. 1.

Reference will now be made to the drawing figures to describe the present invention in detail.

Referring to FIGS. 1-4, a magnetics assembly 100 according to an embodiment of present invention is shown. The magnetics assembly 100 comprises a printed circuit board (PCB) 200 and four transformers 1 mounted thereon. Each transformer 1 comprises a magnetic core 2 and a bundle of wires 3 winding around the magnetic core 2. The magnetic core 2 is shaped as a toroidal shaft extending along a circle locus around a central axial, the toroidal shaft defining a central opening 22, a top and a bottom faces perpendicular to the central axial. The bundle of wires 3 includes a first to eighth wires. The first and second wires are coated with red patent leather, the third and fourth wires are coated with blue patent leather, the fifth and sixth wires are coated with green patent leather, and the seventh and eighth wires are coated with glod patent leather.

The bundle of wires 3 has a central portion with the first to eighth wires twisted together, a first end and an opposite second end. The central portion winds around the magnetic core 2 in one direction through the central opening 22 and around the toroidal shaft some times. The first end of the bundle of wires 3 extends out from central opening 22 through the top face and each wire has a corresponding first end therein. The second end of the bundle of wires 3 extends out from the central opening 22 of the magnetic core 2 through the bottom face, and each wire has a corresponding second end therein. The second ends of the first wire and the second wire, and the first ends of the third wire and the fourth wire are sorted out and twisted to form a central tap 36. The first ends of the first wire and the second wire are sorted out and twisted to form an input 33 of a primary coil of the transformer 1. The second ends of the third wire and the fourth wire are sorted out and twisted to form an output 34 of the primary coil of the transformer 1. The second ends of the fifth wire and the sixth wire, and the first ends of the seventh wire and the eighth wire are sorted out twisted to form a central tap 35. The first ends of the fifth wire and the sixth wire are sorted out and twisted to form an input 31 of a secondary coil of the transformer 1. The second ends of the seventh wire and the eighth wire are sorted out and twisted to form an output 32 of the secondary coil of the transformer 1.

Since the first end of the bundle of wires 3 extends from the top face of the magnetic core 2 and the second end of the bundle of wires 3 extends from the bottom face of the magnetic core 2, it is quite clear that to sort out the red wire ends (first ends of the first and second wires) extending from the top face of the magnetic core 2 to form the input of primary coil, sort out the red wire ends extending from the bottom face of the magnetic core 2 and the blue wire ends extending from the top face of the magnetic core 2 to form the central tap of the primary coil, and sort out the blue wire ends extending from the bottom face of the magnetic core 2 to form the output of the primary coil. It is the same way to sort out the input, the output and the central tap of the secondary coil. In order to more accurately position a length of the coils winding around the core 2, the first end and the second end of the bundle of wires 3 could be first intercrossed, and then sorted out to form the inputs 31, 33, the outputs 32, 34 and the central taps 35, 36. However, this will make it quite troublesome to distinguish which ends of the wires should be the central taps 35, 36 or the inputs 31, 32 or the outputs 33, 34.

The PCB 200 has a plurality of conductive pads 41-43, 51-53 arrayed in first row 4 and a second row 5. The input 33, the output 34 and the central tap 36 of the primary coil are soldered onto corresponding conductive pads 51, 52, 53 in the second row 5. The input 31, the output 32 and the central tap 35 of the secondary coil being soldered onto corresponding conductive pads 41, 42, 43 in the first row 4. It is clearly shown in FIG. 2 that the central tap 36 is soldered onto the conductive pad 53, and the central tap 35 of the secondary coil before the central tap 35 is soldered onto the conductive pad 43. Furthermore, the central tap 36 of the primary coil and the central tap 35 of the secondary coil are intercrossed at a place 365 so that they are positioned mutually before being soldered onto the conductive pads 51-53, 41-43 of the PCB 200.

Figure 3:
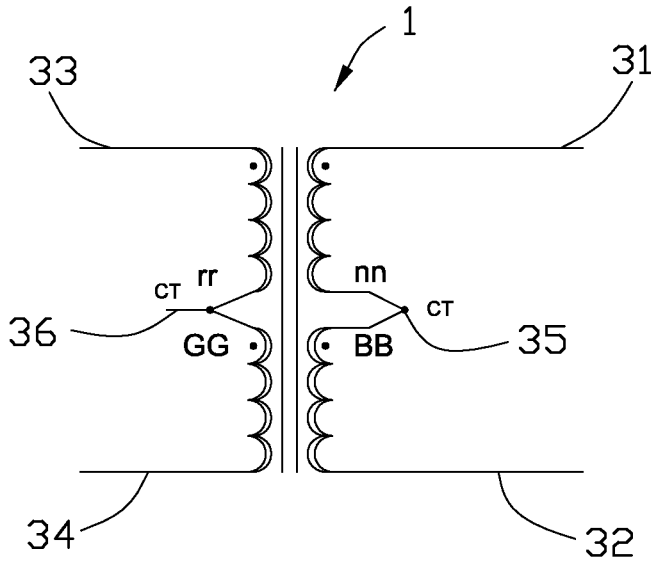
FIG. 3 is a circuitry of a transformer mounted on and the PCB shown in FIG. 1.
Figure 4:
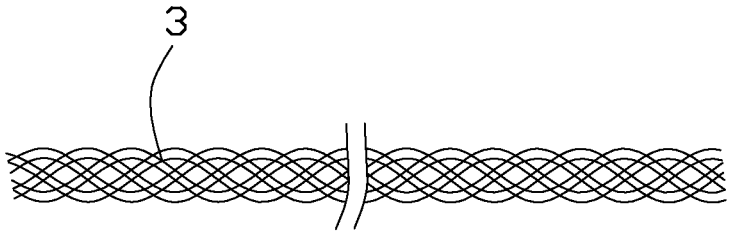
FIG. 4 is a bundle of wires having eight magnetic wires twisted together.
Figure 5:
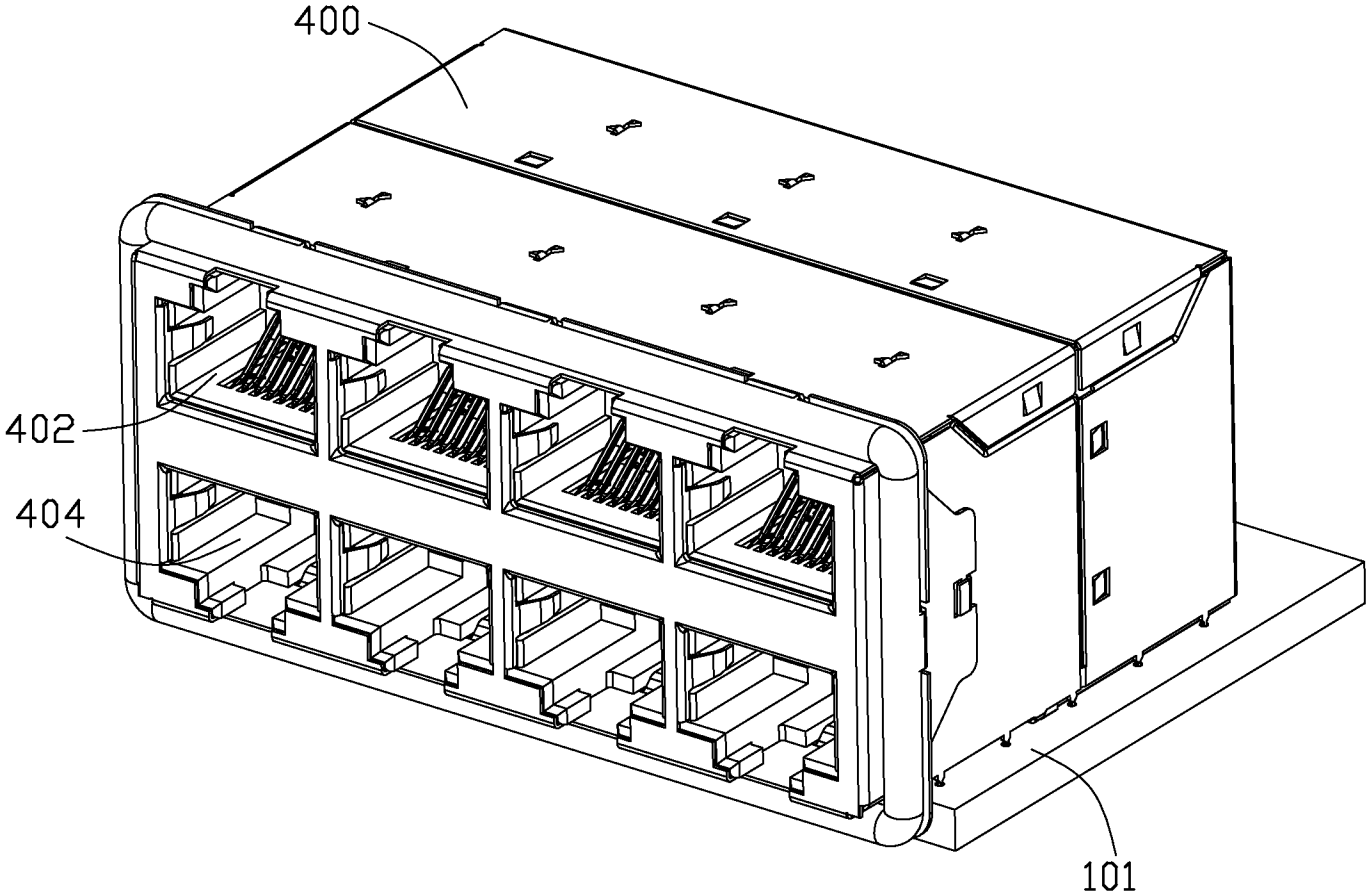
FIG. 5 is a 2XN type RJ 45 connector using the magnetics assembly shown in FIG. 1.
Figure 6:
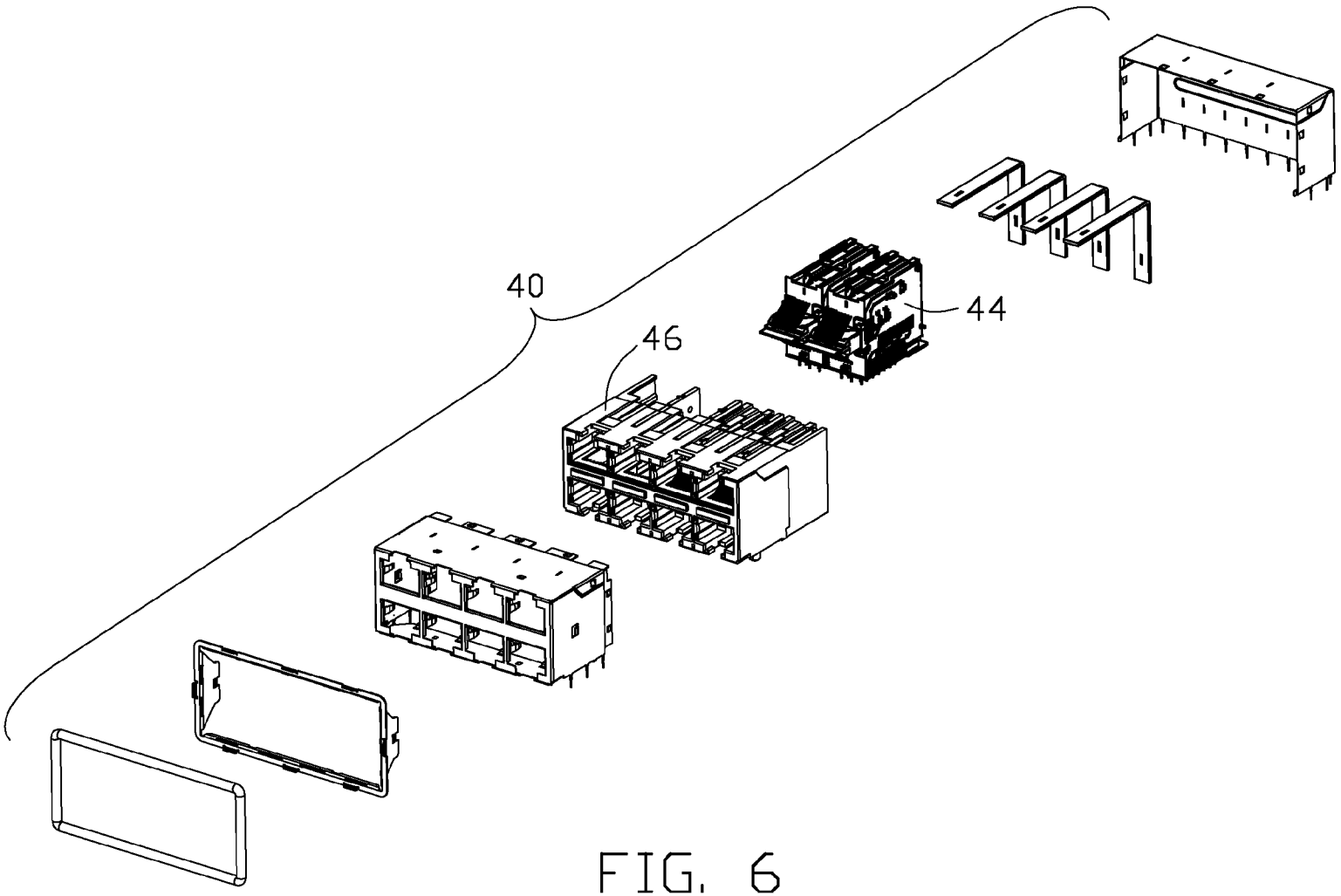
FIG. 6 is an exploded view of the connector shown in FIG. 5.
Figure 7:
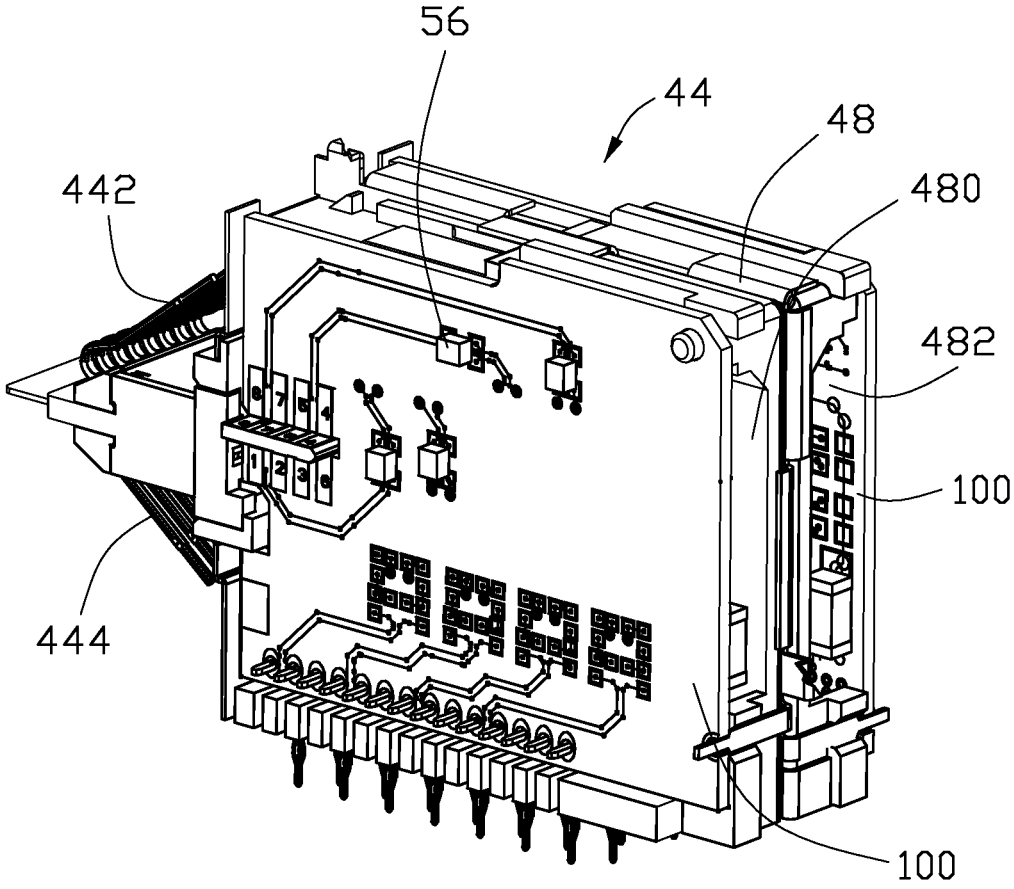
FIG. 7 is a perspective view of a contact module shown in FIG. 5 and having the magnetics assembly shown in FIG. 1.
Figure 8:
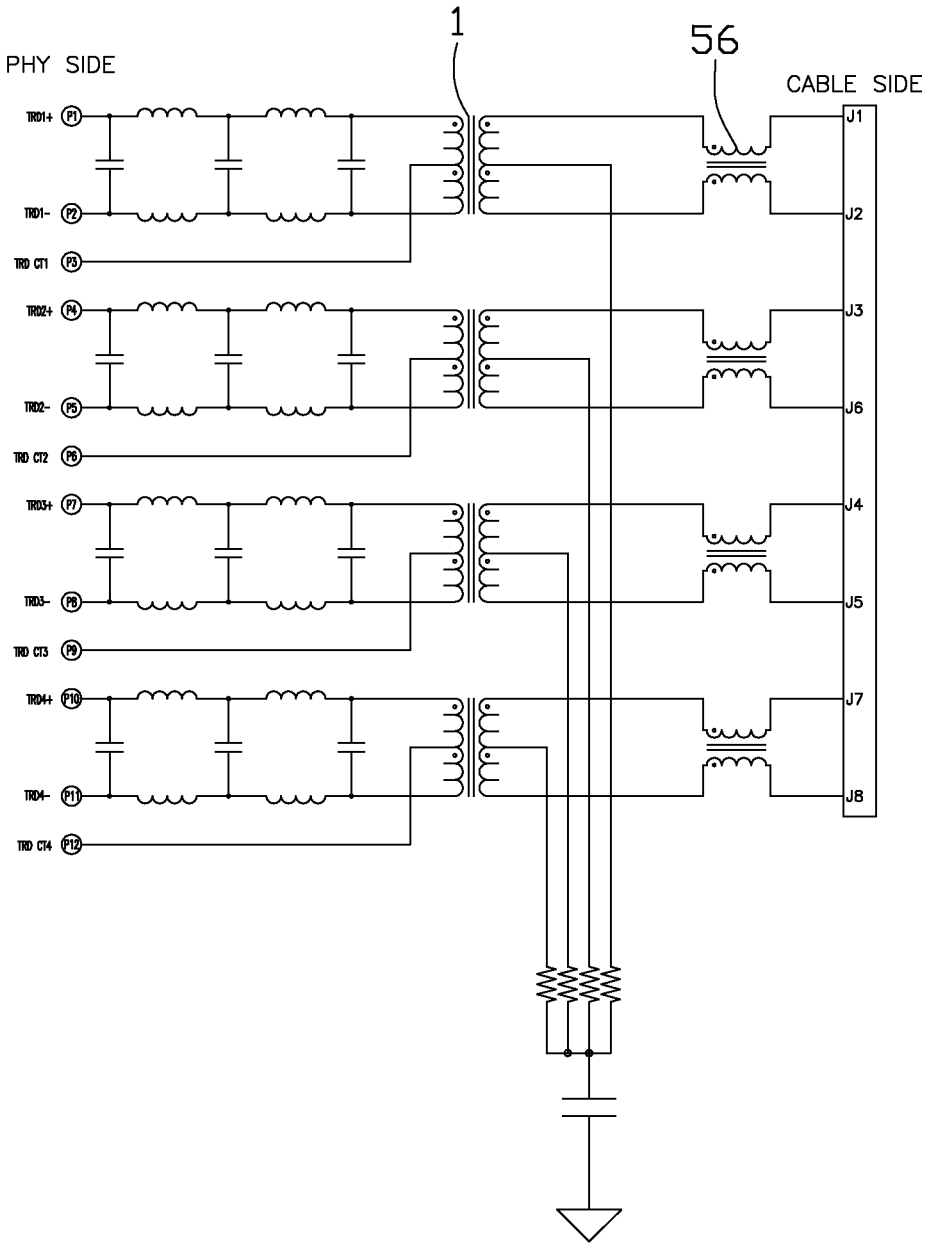
FIG. 8 is a circuitry of one port of the connector shown in FIG. 5.

Through the forementioned connection between the inputs 31, 33, outputs 32, 34, and central taps 35, 36 of the primary coil and the secondary coil, the transformer 1 has two duplicated litz wires to carry each circuit of the primary coil or the secondary coil (clearly shown in FIG. 3). It could be understandable that if necessary, three or more duplicated litz wires could be used to carry each circuit of the transformer 1. Additionally, it is a significant advantage that the circuits of the transformer 1 are duplicated litz wires and all the litz wires are wound around the magnetic core in one time and then sorted out to form the central taps 35, 36, the inputs 31, 32 and the outputs 33, 34.

Referring to FIGS. 5-8, a 2XN type RJ 45 connector 40 having eight magnetic assemblies 100 is shown. The magnetics assembly 100 further comprises four common mode chokes 56 (shown in FIG. 7) mounted on a side of the PCB 200 opposite to the transformers 1. The four common mode chokes 56 are mounted onto the PCB 200 through surface mounted technology and are respectively connected to corresponding transformers 1 by the PCB 200 (shown in FIG. 8). The stacked RJ45 connector 40 has two rows of mating ports 402, 404 stacked vertically. The connector 40 comprises a housing 46 and four contact modules 44 received in the housing 46. Each of the contact modules 44 has two magnetic assemblies 100 and two rows of mating contacts 442, 444 electrically connected to the two magnetic assemblies 100, respectively. The two rows of mating contacts 442, 444 respectively extend into each mating ports for making connection with a RJ 45 plug (not shown) inserted therein.

The contact module 44 further comprise a center frame 48 supporting the two magnetic assemblies 100 and the mating contacts 442, 444. The frame 48 defines two cavities 480, 482 oppositely opened to receive the transformers 1 disposed on inner sides of the two PCBs 200.

A method for making the magnetics assembly 100 comprises the following steps:

(1) providing a first to eighth magnetic wires;

(2) twisting the first to eighth magnetic wires to form a bundle of wire 3 having a first end and an opposite second end;

(3) providing a magnetic core 2 shaped as a toroidal shaft extending along a circle locus around a central axial, the toroidal shaft defining a central opening 22, a top and a bottom faces perpendicular to the central axial;

(4) winding the magnetic wires around the magnetic core 2 in one direction with the first end extending out from the central opening 22 through the top face of the magnetic core 2 and the second end extending out from the central opening 22 through the bottom face of the magnetic core 2;

(5) untwisting the first end and the second end of the bundle of wires to form individual first ends and individual second ends of the first to eighth wires;

(6) twisting the second ends of the first wire and the second wire, and the first ends of the third wire and the fourth wire to form the central tap 36 of a primary coil of the transformer 1, twisting the first ends of the first wire and the second wire to form the input 33 of the primary coil, twisting the second ends of the third wire and the fourth wire to form the output 34 of the primary coil;

(7) twisting the second ends of the fifth wire and the sixth wire, and the first ends of the seventh wire and the eighth wire to form the central tap 35 of the secondary coil of the transformer 1, twisting the first ends of the fifth wire and the sixth wire to form the input 31 of the secondary coil, twisting the second ends of the seventh wire and the eighth wire to form the output 32 of the secondary coil;

(8) intercrossing the central taps 35, 36 of the primary coil and the secondary coil to result a primary position mutually;

(9) providing a printed circuit board 200 having an upper row and a lower row of conductive pads 51-53, 41-43, and soldering the inputs 31, 33, the outputs 32, 34 and the central tap 35, 36 onto respective conductive pads 41-43, 51-53 through thermal welding after step (8); and

(10) providing four surface-mounted-type common mode chokes (CMCs) 56 and soldering the CMCs 56 onto a side of the PCB 200 opposite to the transformer 1 after step (9).

The disclosure is illustrative only, changes may be made in detail, especially in matter of shape, size, and arrangement of parts within the principles of the invention.

What is claimed is:

1. A method for making a magnetics assembly, comprising the steps of:

(1) providing first to eighth magnetic wires, each of the magnetic wires having a first end and a second end in a same order;

(2) providing a toroidal magnetic core having a central opening, a top face, and a bottom face;

(3) winding the first to eighth of the magnetic wires around the magnetic core in one direction with the first end extending out from the central opening through the top face of the magnetic core and the second end extending out from the central opening through the bottom face of the magnetic core;

(4) picking out the second ends of the first wire and the second wire and the first ends of the third wire and the fourth wire to form a centre tap of a primary coil of a transformer, the first ends of the first wire and the second wire to form an input of the primary coil, and the second ends of the third wire and the fourth wire to form an output of the primary coil;

(5) picking out the second ends of the fifth wire and the sixth wire and the first ends of the seventh wire and the eighth wire to form a centre tap of a secondary coil of the transformer, the first ends of the fifth wire and the sixth wire to form an input of the secondary coil, and the second ends of the seventh wire and the eighth wire to form an output of the secondary coil;

(6) twisting the wire ends of the centre taps, the inputs, and the outputs of the primary coil and the secondary coil, respectively; and (7) intercrossing the centre taps of the primary coil and the secondary coil after the step of twisting.

2. The method for making a magnetics assembly as claimed in claim 1, further comprising a step of providing a printed circuit board having a plurality of conductive pads and then thermal welding the inputs, the outputs, and the centre taps onto respective conductive pads.

3. The method for making a magnetics assembly as claimed in claim 2, further comprising a step of providing the conductive pads along a first line and a second line wherein the first line and the second line are located by two sides of the magnetic core, welding the input, the output, and the centre tap of the primary coil onto the conductive pads of the first line, and welding the input, the output, and the centre tap of the secondary coil onto the conductive pads of the second line.

* * * * *